US005568718A

United States Patent [19]

Lerner et al.

[11] Patent Number: 5,568,718

[45] Date of Patent: Oct. 29, 1996

[54] PACKAGING MACHINE AND METHOD

[75] Inventors: Bernard Lerner, Aurora; William M. Cronauer, Tallmadge; Rick S. Wehrmann, Hudson, all of Ohio

[73] Assignee: Automated Packaging Systems, Inc., Streetsboro, Ohio

[21] Appl. No.: 612,292

[22] Filed: Mar. 7, 1996

Related U.S. Application Data

[62] Division of Ser. No. 298,786, Aug. 31, 1994, Pat. No. 5,499,485, which is a division of Ser. No. 954,378, Sep. 30, 1992, Pat. No. 5,394,676.

[51] Int. Cl.[6] ..... B65B 57/08

[52] U.S. Cl. ..... 53/75; 53/77; 53/479; 53/468

[58] Field of Search ..... 53/75, 76, 77, 53/477, 479, 508, 507, 468, 459, 64, 373.7

[56] References Cited

U.S. PATENT DOCUMENTS

| | | | |
|---|---|---|---|
| Re. 32,963 | 6/1989 | Lerner et al. . | |
| 3,355,857 | 12/1967 | Tobey . | |
| 3,477,196 | 11/1969 | Lerner . | |
| 3,545,166 | 12/1970 | Johnson et al. | 53/459 |
| 3,815,318 | 6/1974 | Lerner . | |
| 3,925,139 | 12/1975 | Simmons | 53/75 X |
| 3,965,653 | 6/1976 | Lerner . | |
| 4,041,846 | 8/1977 | Lerner . | |
| 4,202,153 | 5/1980 | Lerner et al. . | |
| 4,334,399 | 8/1982 | Onishi | 53/459 X |
| 4,510,736 | 4/1985 | Muller | 53/567 |
| 4,546,596 | 10/1985 | Cherney | 53/75 X |
| 4,586,318 | 5/1986 | Litt et al. | 53/459 |
| 4,651,506 | 3/1987 | Lerner et al. | 53/459 |
| 4,674,268 | 6/1987 | Gavronsky et al. | 53/468 |
| 4,768,327 | 9/1988 | Mosher | 53/75 X |
| 4,835,948 | 6/1989 | Humphrey | 53/567 |
| 4,899,520 | 2/1990 | Lerner et al. . | |
| 5,134,835 | 8/1992 | Walkiewicz, Jr. et al. | 53/568 |
| 5,147,491 | 9/1992 | Thomas et al. | 53/75 X |
| 5,289,671 | 3/1994 | Lerner et al. | 53/75 X |

FOREIGN PATENT DOCUMENTS

| | | |
|---|---|---|
| 207838 | 6/1986 | European Pat. Off. . |
| 0429416 | 5/1991 | European Pat. Off. . |

OTHER PUBLICATIONS

Search report—European patent application 93306802.

*Primary Examiner*—James F. Coan

*Attorney, Agent, or Firm*—Watts, Hoffmann, Fisher & Heinke Co. L.P.A.

[57] ABSTRACT

A packaging machine that has improved features for feeding a web in the form of a continuous chain of bags through the machine while helping to maintain the web in proper alignment and proper tension, and having additional features for improved loading and sealing of the bags. The machine includes a jam prevention device having a prime mover driven damping sub-assembly which includes a seal bar and a reciprocatable seal pad and housing. The housing is spring-mounted on the clamping sub-assembly in a lost motion arrangement. Movement of the seal pad toward bring a loaded bag into contact with the heater bar sub-assembly is aborted if a sensor detects premature lost motion movement of the pad. Control structure either allows or disallows the sealing process to continue based upon sensor signals.

15 Claims, 8 Drawing Sheets

PACKAGING MACHINE AND METHOD

REFERENCE TO RELATED CASES

This is a division of U.S. patent application Ser. No. 08/298,786, filed Aug. 31, 1994, now U.S. Pat. No. 5,499,485, issued Mar. 19, 1996, which in turn was a division of Ser. No. 07/954,378 filed on Sept. 30, 1992, now U.S. Pat. No. 5,394,676 issued on Mar. 7, 1995. Additional disclosure is incorporated from U.S. patent application Ser. No. 07/954,305, now U.S. Pat. No. 5,289,671 filed Mar. 1, 1994 which was concurrently filed with and incorporated by in its entirety in the grandparent application. Each of the patents is entitled Packaging Machine & Method.

TECHNICAL FIELD

The present invention relates generally to an apparatus and method for forming packages by sequentially loading and separating bags from a web in the form of a chain of interconnected and pre-opened bags and more particularly to sealing those packages with a sealing section equipped with a jam preventer.

BACKGROUND

The use of chains of pre-opened bags to form packages is well known. Such chains of bags are disclosed and claimed in U.S. Pat. No. 3,254,828 entitled FLEXIBLE CONTAINER STRIPS (the Autobag patent). A commercial version of a machine described and claimed in U.S. Pat. No. 3,815,318 entitled PACKAGING APPARATUS, and in other patents deriving from the application that resulted in this patent (the H-100 patents), has been sold commercially by Automated Packaging Systems, Inc. under the designation H-100. A machine described in U.S. Pat. No. 4,899,520 entitled PACKAGING APPARATUS AND METHOD includes an ability to use two chains of interconnected bags while packaging and has been sold commercially by Automated Packaging under the designation H-200.

With the machines of the H-100 and H-200 patents loaded, bags are sealed at sealing stations each through contact with a heater bar which melts a portion of the plastic. During the sealing operation, the weight of a bag's contents and bag separation forces are isolated from the seal by spring-biased grippers which are moved into bag engagement by a clamping sub-assembly that concurrently brings the loaded bag into contact with the heater bar. All of these moving parts can be interfered with by a product that is only partially loaded or a foreign object thereby causing jams which can damage the machine and/or the product or can cause an improper seal which creates an unacceptable package.

SUMMARY OF THE INVENTION

The present invention provides a packaging machine having an improved sealing section. This sealing section has a simple yet effective jam prevention device that is useful in different situations for detecting jams or potential jams.

In the preferred embodiment, a packaging machine for loading bags includes a bag sealing section wherein the sealing section includes a frame structure and a light beam source mounted on the frame structure and adapted to emit an intermittent fight beam. A heater bar is connected to the frame structure and located in close proximity to the light beam source. A reciprocatable support assembly is movably connected to the frame structure and includes a prime mover for causing reciprocation of the support assembly.

A clamping sub-assembly is connected to the support assembly. In use, the sub-assembly brings loaded bags into contact with the heater bar and clamps the loaded bag against the heater bar. The clamping sub-assembly includes a seal pad and a reciprocatable housing for the seal pad. The housing is spring biased to normally position the housing such that it substantially surrounds the seal pad.

Two reflective devices are located in the path of the light beam source for reflecting the fight beam when emitted by the source. The reflective devices are located at opposite ends of the seal pad housing. A receiver is connected to the frame structure opposite the light beam source and receives the beam after reflection by the reflective devices.

An electronic control is provided for sensing reception of the reflected beam by the receiver and for controlling operation of the sealing section based upon such reception.

In the preferred embodiment, two cavities that serve as interrupters are defined within the clamping sub-assembly, one for each reflective device. Each reflective device enters its respective cavity upon reciprocation of the seal pad housing. The reciprocation of the seal pad housing occurs during contact between the heater bar and the clamping sub-assembly. When the reflective devices enter the cavities, the reflection of the light beam is disrupted by the cavities.

One of the outstanding features of the jam prevention mechanism of this invention is that it is functional both to sense the presence of a foreign object that may cause a jam and also to sense certain machine component failures. To accomplish this feature, light beam interruption during an initial portion of a sealing cycle indicating the presence of a foreign object will result in aborting of the seal cycle. Failure of the beam to be interrupted during a later portion of the cycle is an indication of a machine component failure and will also result in aborting of the cycle.

Thus, the jam prevention device operates to disrupt the operation of the sealing section whenever the light beam or its reflection is disrupted during an initial portion of support assembly motion during a sealing cycle. Undesired disruption of the light beam or its reflection can be caused by either a foreign object in its path or can occur by premature seal pad housing movement, causing the reflective devices to enter the cavities.

Once the clamping sub-assembly engages the heater bar, the housing shifts to cause the reflective devices to enter the cavities, and disrupt the light beam. This disruption is desirable because it is indicative of proper machine functioning, and the required meeting of the clamping sub-assembly and the heater bar has occurred. To this end, the electronic control includes a sensing device for sensing the meeting of the clamping sub-assembly and the heater bar. Once the meeting of the clamping sub-assembly and the heater bar sub-assembly is sensed, if the control structure does not sense the disruption of the light beam, the sealing process is interrupted. This feature of the jam prevention device also allows the electronic control to be monitored in that if the control "short circuits" and reception of the light beam is indicated when such reception is undesirable, the sealing process will be interrupted.

A microprocessor is utilized to determine if the two sub-assemblies have met in a predetermined amount of time. If they have not met within the predetermined amount of time, such as because an obstruction that is not disrupting the light beam is preventing meeting of the two sub-assemblies, the sealing process is interrupted.

Accordingly, the object of this invention is to provide a novel and improved packaging machine having an improved jam prevention device and a method of detecting obstructions and malfunctions in a packaging machine's sealing section.

These and other features and objects of the invention will be better understood after considering the detailed description in conjunction with the drawings.

DESCRIPTION OF THE PREFERRED EMBODIMENT

Figure 1:
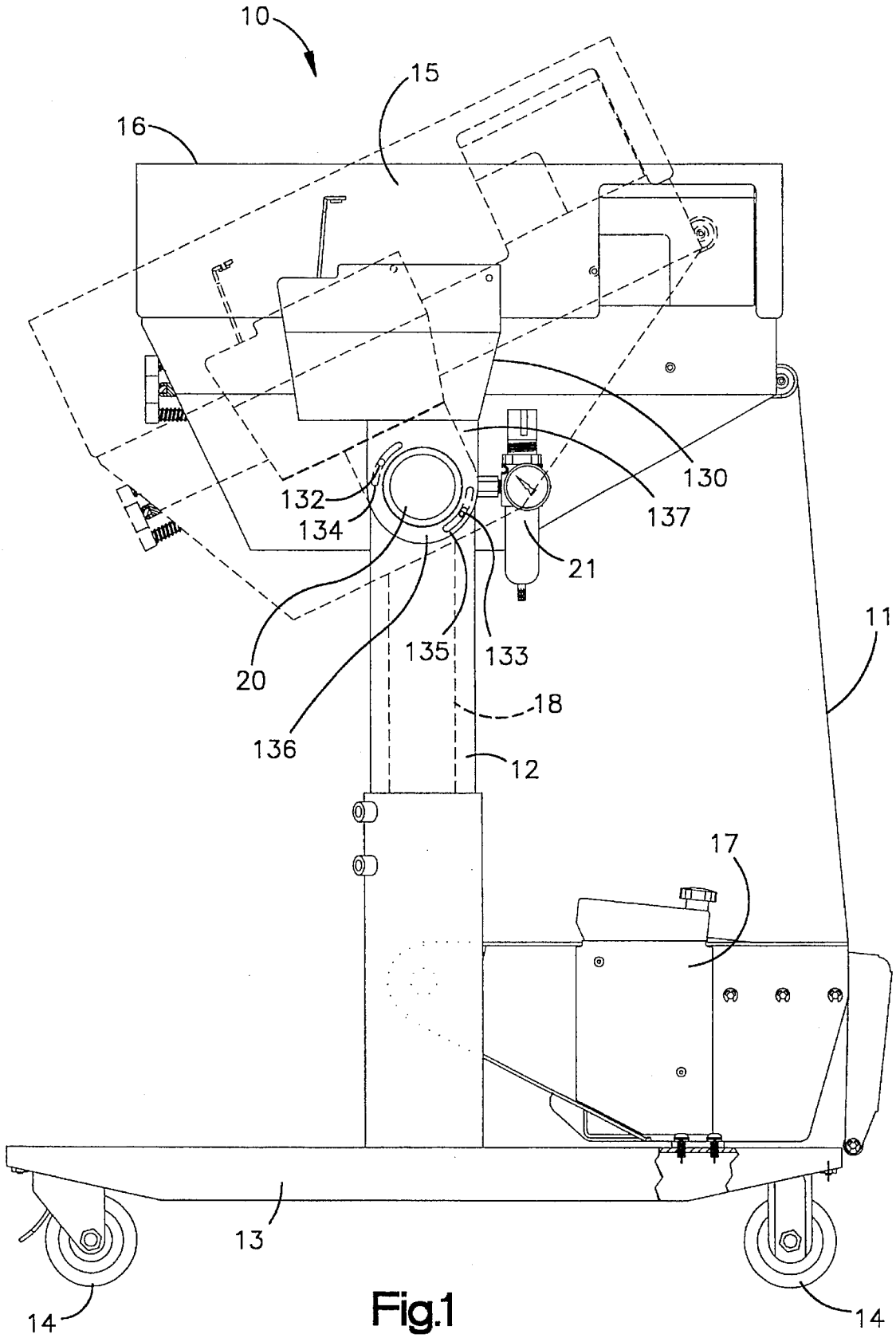
FIG. 1 is a side elevational view of a packaging machine embodying the present invention.

Referring to the drawings, a packaging machine constructed in accordance with a preferred embodiment of the invention is illustrated generally at 10. The machine 10 is constructed to load bags from a web 11 in the form of an interconnected chain of open bags. The bags are preferably connected together along lines of weakness so that each bag can be separated from the web after it has been loaded with a product.

The packaging machine 10 includes an upstanding support frame 12 that sits atop a base 13. The base 13 is supported by rollers 14 that allow the packaging machine 10 to be moved easily. The packaging machine 10 further includes a bagger 15 that is cantilever mounted on the support frame 12. The bagger includes a removable housing or cover 16 that encloses the bagger and covers a bagger web feed mechanism. A web supply and tensioning device 17 is connected to base 13 below the bagger 15.

Figure 5:
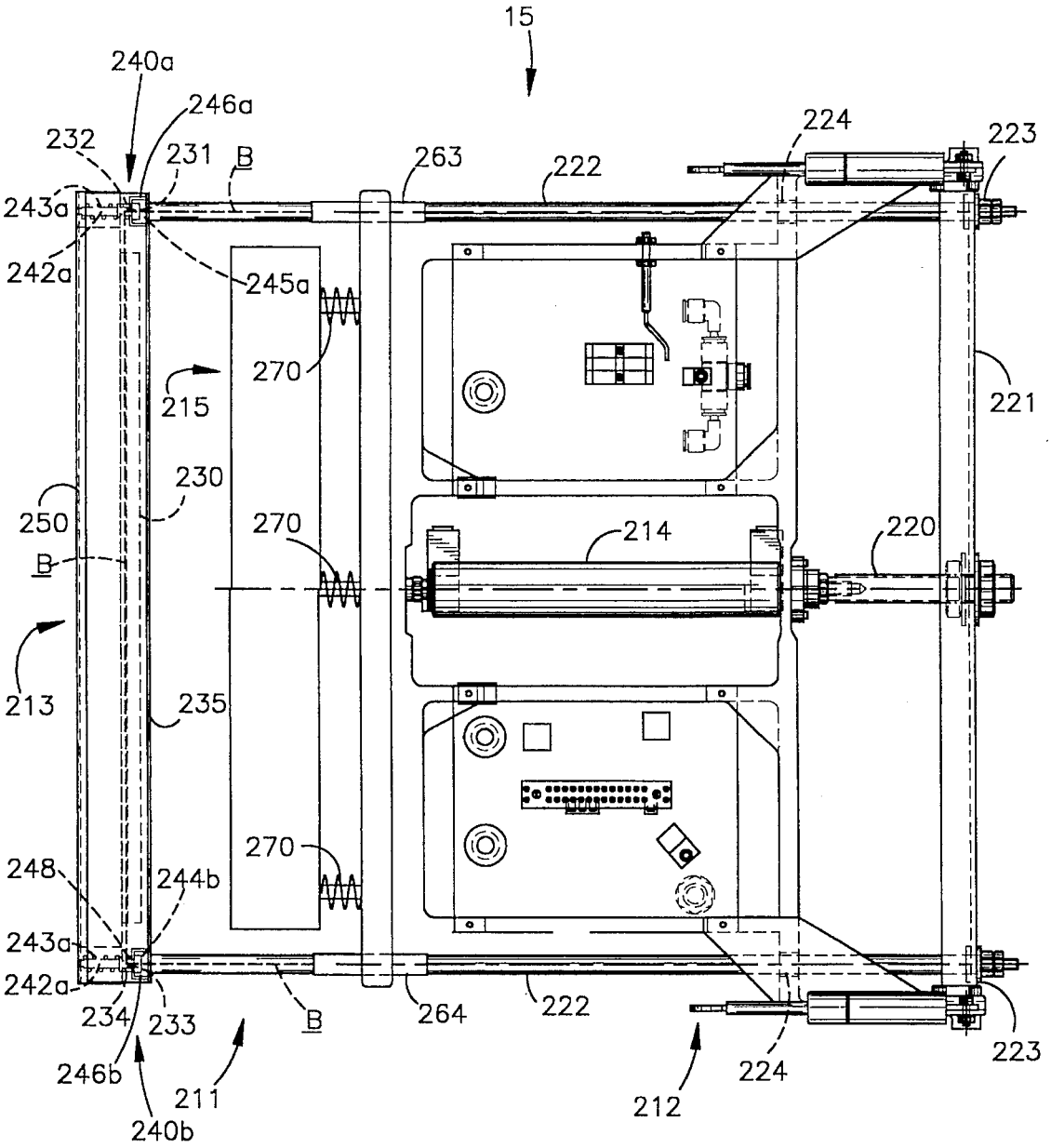
FIG. 5 is a plan view of a packaging machine sealing section embodying the invention.
Figure 6:
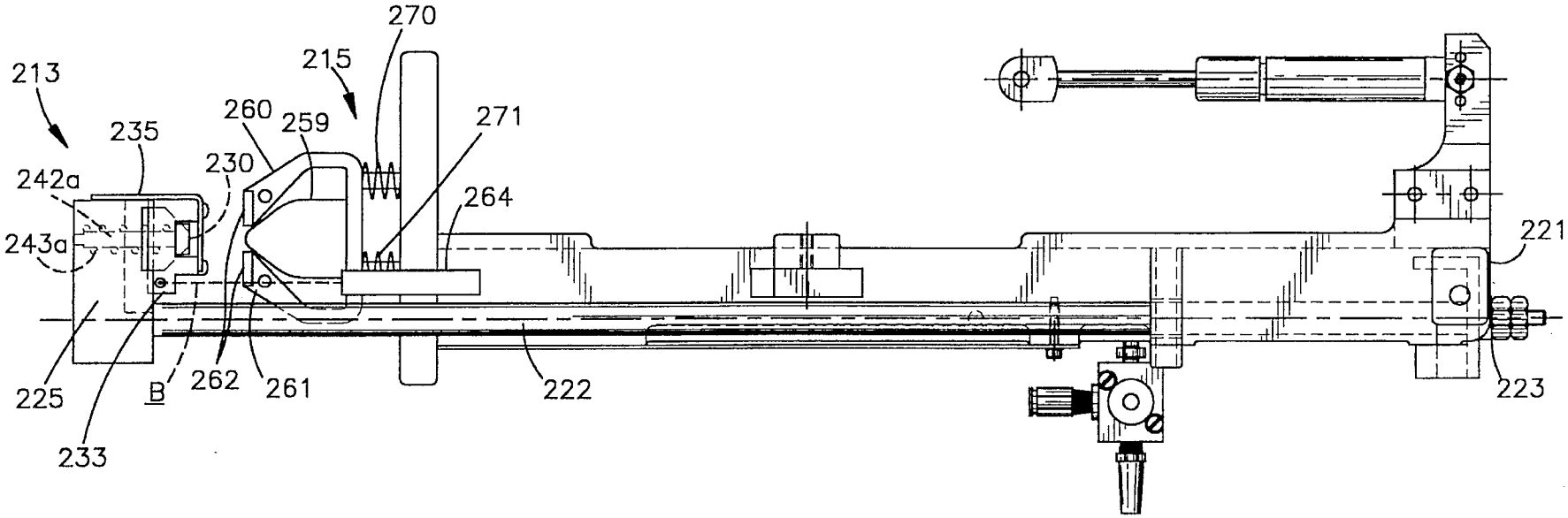
FIG. 6 is a side elevational view of the sealing section on an enlarged scale with respect to FIG. 5.
Figure 7:
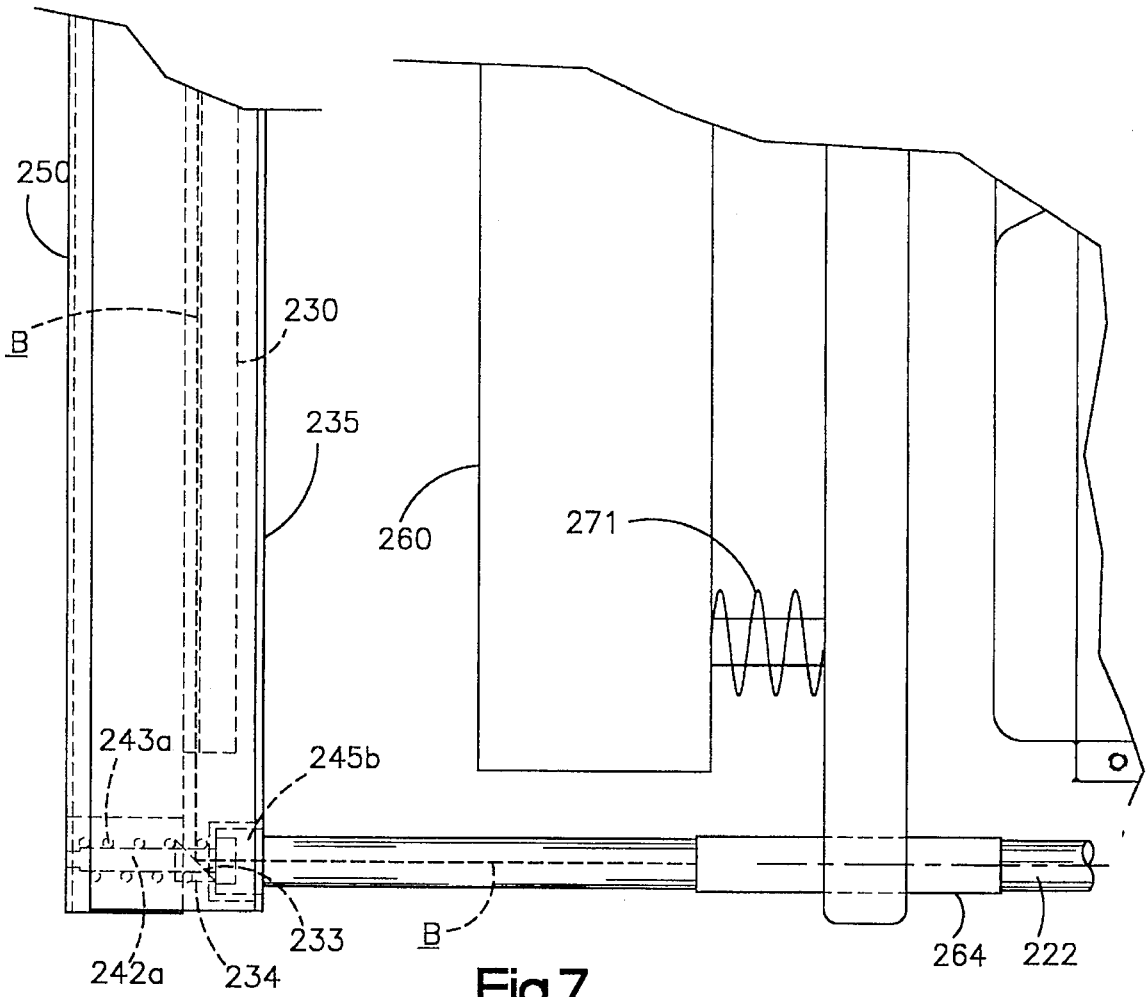
FIG. 7 is a still further enlarged fragmentary plan view of the sealing section.
Figure 10:
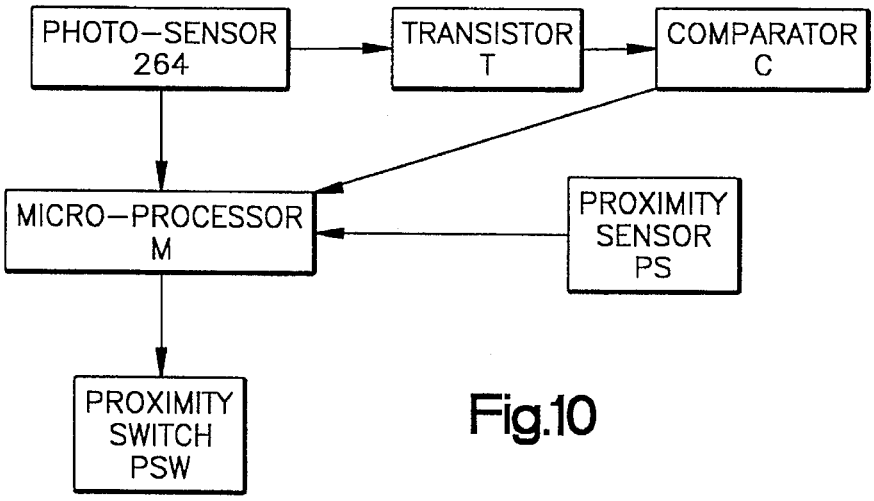

The support frame 12 is preferably a hollow, single-leg frame that is, as is best seen in FIG. 5, laterally offset to one side of the base 13. An enclosed inner chamber 18 (FIG. 1) of the support frame forms a portion of an air manifold. A support arm 20 projects laterally from the support frame 12. The arm 20 is the cantilever support for the bagger 15. The arm 20 is also preferably hollow to provide an air chamber which is in communication with the chamber 18 to form a further portion of the air manifold. To this end, the tube 20 projects through and is secured to the stand 12, FIG. 5.

Apertures A in the arm 20 provide fluid communication between the chambers of the stand and the An air regulator 21 is connected to the support frame 12 and is connectable to an external air supply source (not shown). The air regulator allows air from an external source to enter the air manifold and maintain the air within the manifold at a desired pressure. A set of connectors 22 are provided along the support arm 20, FIG. 4, for connection of accessories (not shown). If an accessory requires a reduced air pressure, an air regulator can be attached to a connector in order to adjust the pressure of the air supplied by the manifold.

THE BAGGER FEED MECHANISM

Figure 2:
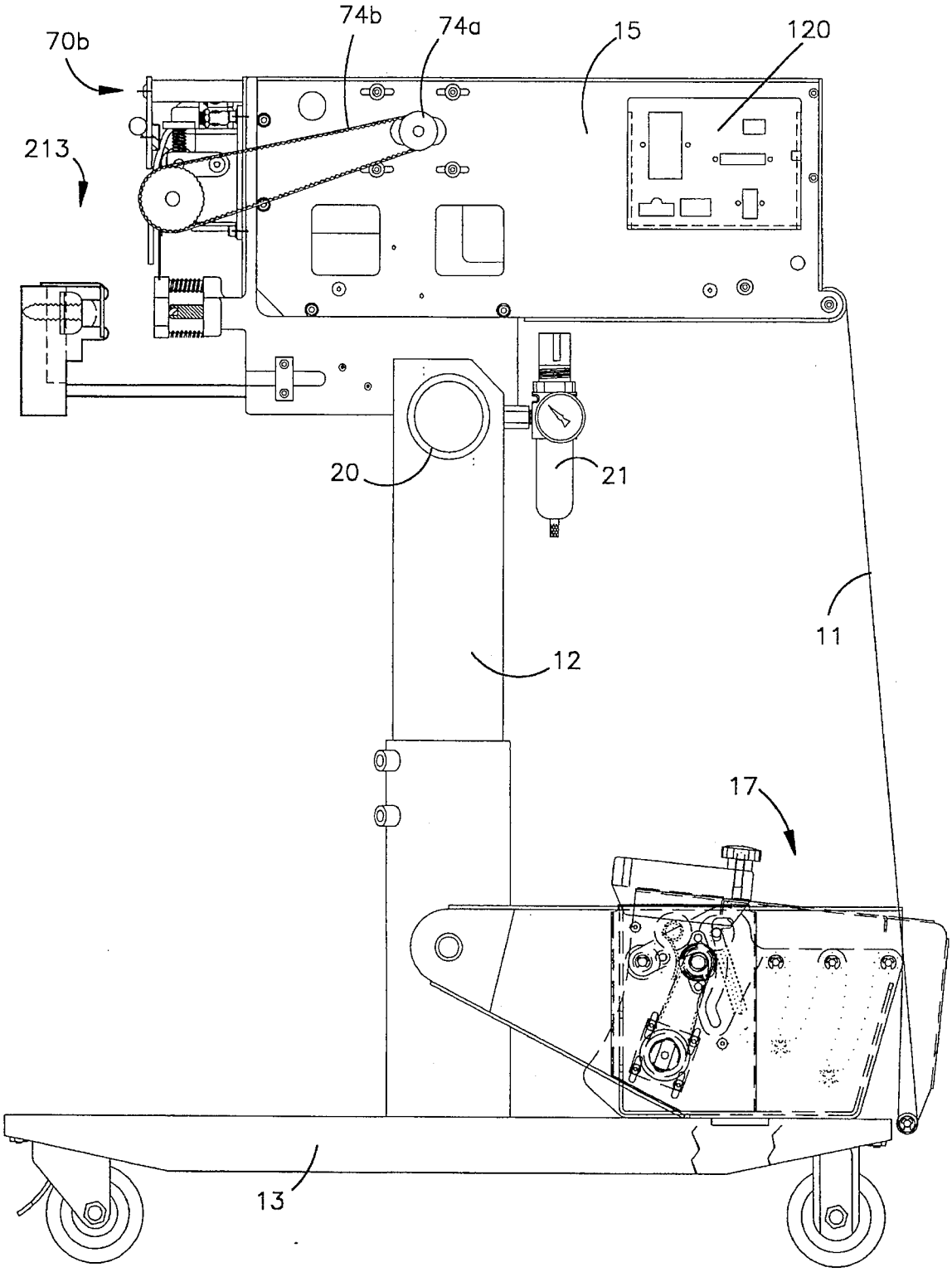
FIG. 2 is a side elevational view of the packaging machine of FIG. 1 with parts of the bagger broken away and removed and a partial sectional view of a web tensioning device.
Figure 4:
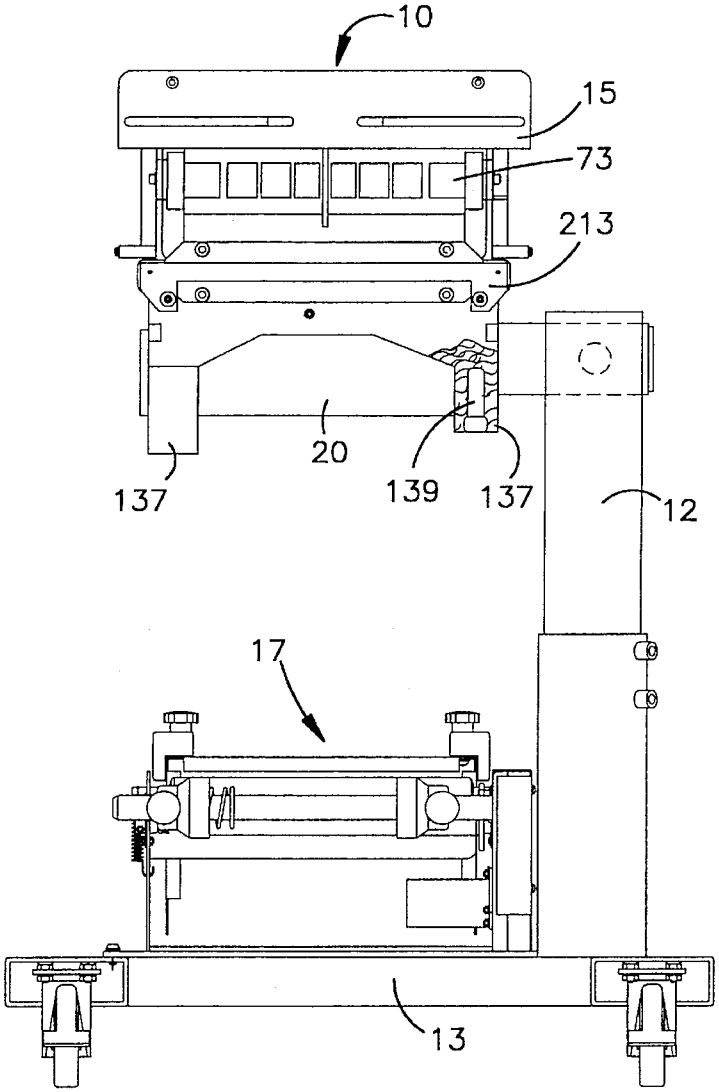
FIG. 4 is a front elevational view of the packaging machine of FIG. 1 on a reduced scale.

As best seen in FIGS. 2 and 4, after the web travels through the web supply and tensioning device 17, it travels upwardly through a second section of the web path to the bagger 15. Optionally, accessory devices (not shown) may be positioned along the second section. The bagger feed mechanism functions to isolate downstream tensional effects from the second section so that the mechanism and the device 17 cooperate to isolate this second section from up and downstream tensional forces.

Figure 3:
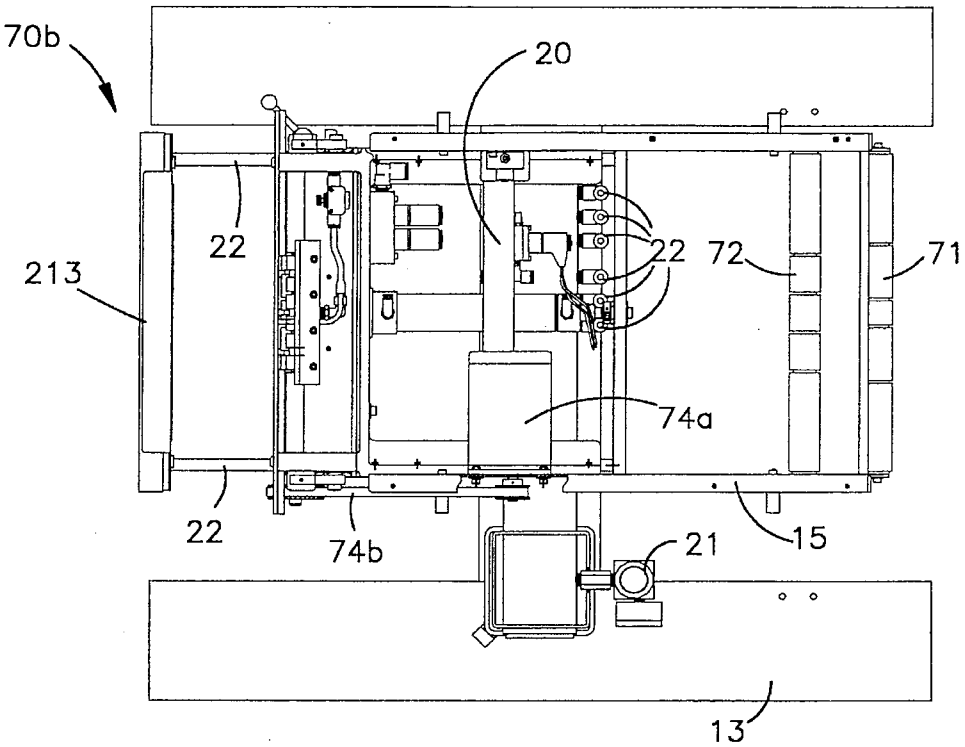
FIG. 3 is a top plan view of the packaging machine of FIG. 1.

The feed mechanism defines a third section of the web path of travel. An idler roll 71 over which the web 11 is fed delineates the upstream end of the mechanism. A second idler roll 72 is further along the web path of travel within the bagger, FIG. 4. The path extends from the idler roll 72 to a pair of load station nip rolls, one of which is shown at 73, FIG. 5, positioned adjacent an output end **70*b* of the bagger 15. The nip rolls are driven by a stepper motor 74*a*, FIG. 3 via a belt 74*a*. The nip rolls are driven in a forward direction to feed the web 11** to position bags for loading and sealing and in a reverse direction to separate a loaded bag being sealed from the web.

Turning now to FIGS. 7–12 of the drawings, portions of the bagger 15 having a sealing section 211 and a frame structure 212 are illustrated. The sealing section 211 includes a damping sub-assembly 213 connected to a prime mover, preferably in the form of an air cylinder 214. A heater bar sub-assembly 215 is connected to and mounted on the frame structure 212.

The air cylinder 214 is mounted centrally of the frame 212. The cylinder includes an actuating rod 220. A channel-like cross member 221 is connected to the actuating rod 220. Guide rods 222 are secured near distal ends 223 of the cross member 221 and extend toward the front of the machine. The guide rods are slidably received (and supported) by bores 224 formed in the frame 212. Other bores (not shown) slidably receive the guide rods 222 and support the rods 222 near the front end of the bagger 15. The clamping sub-assembly 213 extends between the front ends of the guide rods 222 so that when the prime mover 214 is energized to extend the actuating rod 220, the damping sub-assembly 213 is pulled inwardly towards the heater bar sub-assembly 215.

The damping sub-assembly 213 includes a sealing pad 230 connected to a support 225 which in turn is connected to the guide rods 222. A reflective device 231 is located at a corner end portion 232 of the support 225 and a second reflective device 233 is located at an opposite corner end portion 234.

A sealing bar housing 235 is connected to the support 225 via lost motion connections **240*a*, 240*b* and substantially surrounds the sealing pad 230. The lost motion connections 240*a*, 240*b* respectively comprise pins 242*a*, 242*b* and springs 243***a*, 243*b*. Each of the pins 242*a*, 242*b* has a corresponding head 244*a*, 244*b*. The springs 243*a*, 243*b* are mounted around the corresponding pins 242*a*, 242*b* between a back portion 250 of the housing 235 and the corresponding heads 244*a*, 244*b*. Each head 244*a*, 244*b* is located within an associated one of recesses 245*a*, 245*b* defined by the housing 235. The springs bias the housing 235 such that respective back portions 46*a*, 46*b* of the recess 45*a*, 45*b* normally engage a corresponding head 244*a*, 244*b*.

Figure 8:
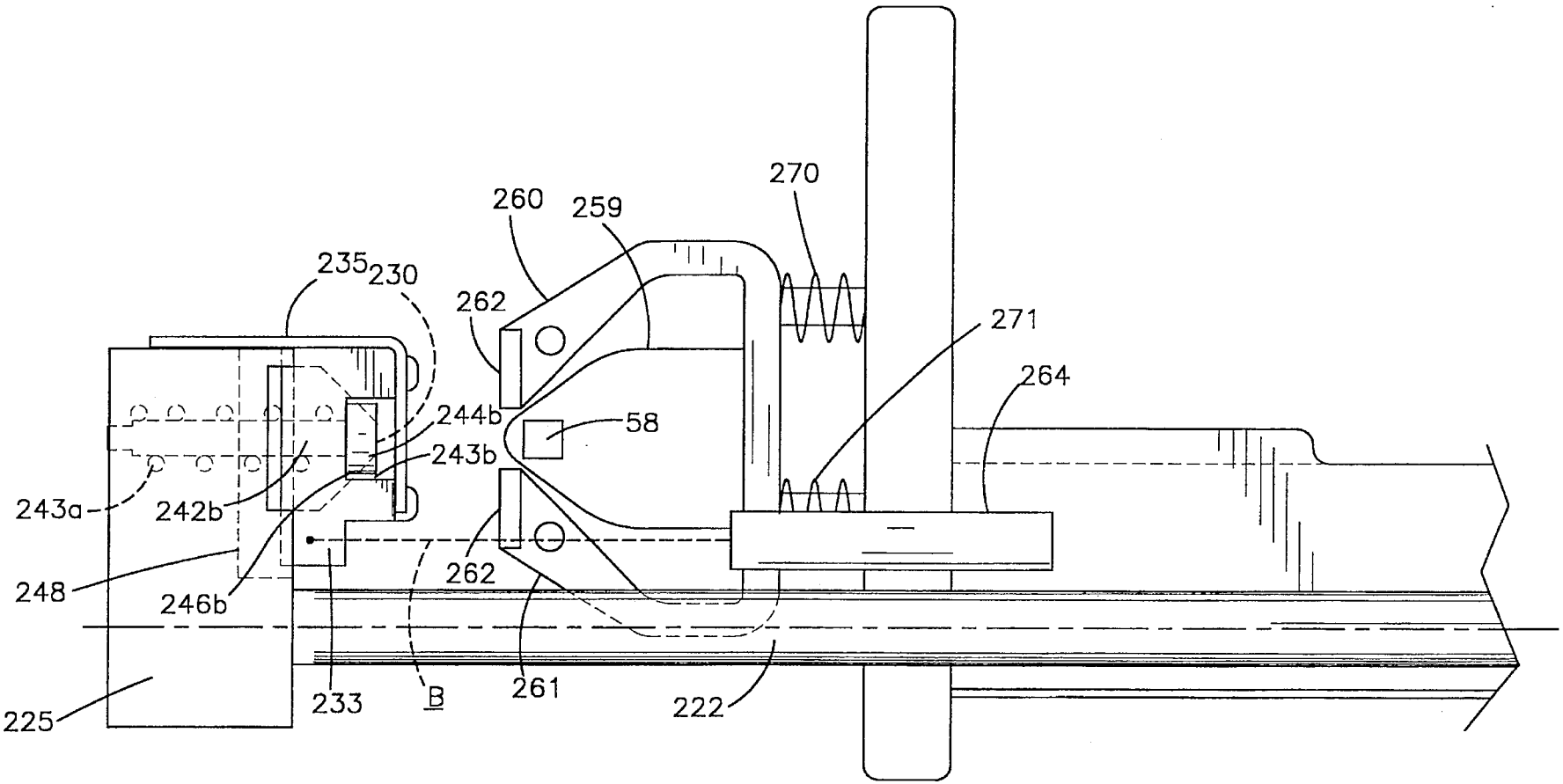
FIG. 8 is a still further enlarged fragmentary side elevational view of the sealing section.
Figure 9:
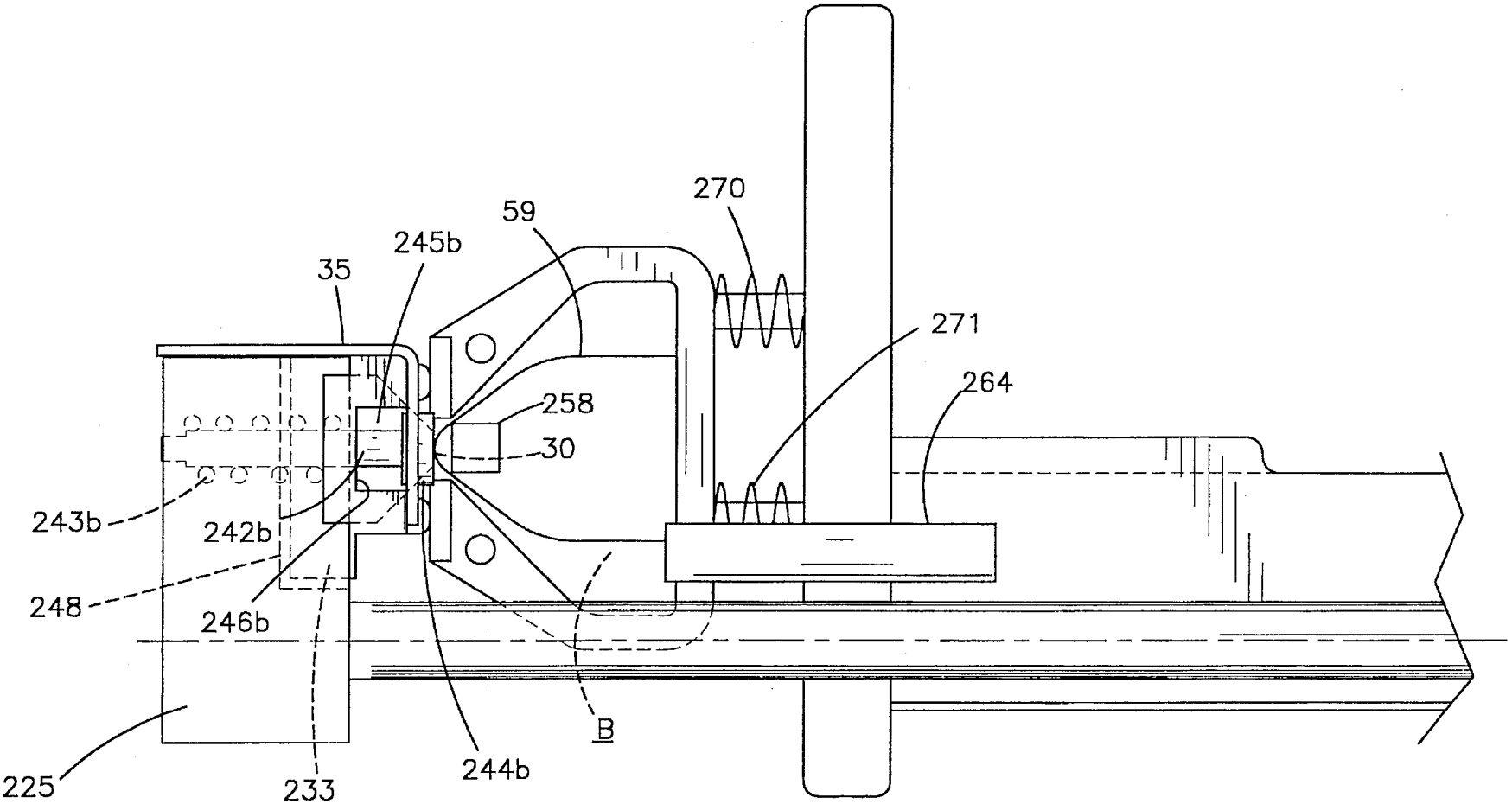
FIG. 9 is a fragmentary view on the scale of FIG. 8 of the sealing section illustrating a clamping sub-assembly engaging a heater bar; and, FIG. 10 is a flow chart illustrating a control system of a jam prevention system for a packaging machine sealing section embodying the invention.

The support 225 defines two cavities respectively positioned to receive the reflective devices 231, 233. FIG. 8 illustrates the clamping sub-assembly prior to engaging the heater bar sub-assembly. FIG. 9 illustrates the clamping sub-assembly meeting the heater bar sub-assembly.

The heater bar sub-assembly 215 includes a heater bar 258 surrounded by a Teflon® cover 259 and upper and lower gripper plates 260, 261, which flank the heater bar. Each of the gripper plates 260, 261 has a flat surface 262 facing the clamping sub-assembly 213.

An infrared emitter 263 is connected to the frame 212. Preferably, the emitter emits a pulsed or intermittent signal with 15 microsecond pulses at 10 KHz. The emitter 263 serves as a light source which emits a light beam B direct toward the reflective device 231 along a beam path. The light beam B is reflected off of the reflective device 231, which is at a 45° angle relative to an incident portion from the emitter. The beam path is reflected 90° from the incident portion to a second path portion directed at the reflective device 233. The light beam is then reflected off of the reflective device 233, which is at a 45° angle relative to the second path portion of the beam path. An infrared receiver 264 is positioned to receive the beam after a second 90° reflection by the reflective device 233. The receiver is preferably in the form of a photosensor. The intermittent or pulsed form of the light beam allows the receiver 264 to distinguish the light beam from ambient light.

OPERATION

In operation the chain of interconnected and pre-opened bags 11 is fed through the bagger 15 to deliver bags to be loaded and then sealed by the sealing section 211. Once a positioned bag is loaded, the prime mover 214 moves the clamping sub-assembly 213 towards the heater bar sub-assembly 215 in order to effect a seal of a loaded bag (not shown) by bringing the loaded bag into contact with the heater bar sub-assembly 215. The bag is clamped and held in place against the gripper plates 260, 261 by the sealing pad 230. The pressure of the damping sub-assembly 213 shifts the plates 260, 261 against the action of springs 270, 271 until the pad 230 forces the bag against the bar. In addition, the pressure exerted by the damping sub-assembly 213 when it meets the heater bar sub-assembly 215 causes the sealing bar housing 235 to move along the lost motion connections 240, 241 as seen in FIG. 9. This moves the reflective devices 231, 233 into the cavities and disrupts the light beam.

During operation, the photo-sensor 264 receives the reflected light beam B and generates an output signal corresponding to reception or non-reception of the light beam. The photo-sensor's signal activates a transistor T. Output of the transistor is coupled to a comparator C that stretches the 15-microsecond light beam pulse to approximately 150 microseconds. If the reception of the light beam B is disrupted for any reason during an initial portion of a sealing cycle, such as by obstruction of the light beam B by a foreign object or premature movement of the housing 235 via the lost motion connections, the photo-sensor signal causes the prime mover 214 to reverse its movement.

Upon the meeting of the damping sub-assembly 213 and the heater bar sub-assembly 215, and thereby the movement of the housing 235 via the lost motion connections 240, 241, a microprocessor M operates to sense the proper movement of the housing 235. The microprocessor "knows" when the clamping sub-assembly 213 should have met the heater bar sub-assembly 215. The meeting is determined by a proximity sensor PS that senses movement of two relatively movable members. When the proximity sensor senses the damping sub-assembly meeting the heater bar sub-assembly, output from a proximity switch PSW coupled to the microprocessor changes state. If the light beam is not disrupted at this point, thereby signalling a machine malfunction such as the failure of the housing 235 to move via the lost motion connections, the sealing operation is interrupted. Once the loaded bag is sealed, the prime mover 14 moves the clamping sub-assembly 13 away from the heater bar assembly 15.

Additionally, if there is a machine malfunction such as if the transistor coupled to the output from the photo-sensor short-circuits causing the output to indicate that the light beam is present when it is not, the sealing cycle will be aborted. Thus, a failure not due to a problem with the sealing section 11, disables the sealing section because of the requirement for disruption of the light beam.

The microprocessor also monitors the output of the comparator. If the time period for pulsing drops below 150 microseconds, it is an indication a lens of the emitter 263 and/or a lens of the receiver 264 is dirty. A signal is then given to an operator to check and clean the lens.

THE ELECTRONIC CONTROLS

Electronic controls for the machine 10 are contained within a housing 120. The controls include a controller board defining a bus system and one or more auxiliary boards coupled to the bus system. The housing 120 is a removable section of the bagger 15 and therefore can easily be removed as a unit for maintenance and service as opposed to individually removing electrical circuit boards or other components. The structure and operation of the electronic control system of the machine 10 is more fully described in a copending patent application, which is incorporated herein in its entirety by reference, entitled "Bagging Control Apparatus and Method," Attorney's Docket 12-809, filed Aug. 27, 1992 and owned by a common assignee.

An input module 130 is connected to the support frame 12. The input module 130 includes a keypad (not shown) that allows operator input for programming and controlling the machine 10.

The bagger 15 and input module 130 are individually pivotable as illustrated in phantom in FIG. 1. Two screws 132, 133 are respectively contained within slots 134, 135 located within a portion of a module support bracket 136. By loosening the screws 132, 133, the module can be rotated about an extension of the tube 201 to position the keypad at a desired orientation.

Split clamps 137, FIG. 5, rotatively fix the bagger 15 at a desire orientation on the tube 20. Loosening of cap bolts 139 (only one of four being shown in FIG. 5) allows the bagger to be rotated to a desired orientation and then clamped in that orientation.

Although the preferred embodiment of this invention has been shown and described, it should be understood that various modifications and rearrangements of the parts may be resorted to without departing from the scope of the invention as disclosed and claimed herein.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

We claim:

1. A process of packaging with a bagging machine for sequentially delivering end ones of a chain of interconnected preopened bags to a loading and sealing station, the machine having a seal bar and a reciprocatably mounted seal pad assembly including a pad and a coacting housing, the pad being for pressing top portions of a loaded bag to be sealed against the bar, the method comprising:

a) positioning a bag to be loaded at the station;

b) opening the positioned bag and inserting contents to be packaged;

c) moving the assembly along a path of travel toward the seal bar;

d) sensing lost motion movement of at least a selected one of the pad and housing relative to other parts of the assembly;

e) determining whether the sensed lost motion movement was during an early or a late portion of the assembly movement along the path and toward the seal bar;

f) stopping the assembly movement toward the seal bar when it is determined that the sensed lost motion movement was during the early portion;

g) allowing the assembly movement to continue toward the seal bar when it is determined the lost motion movement was in the late portion; and, h) continuing the assembly movement until said top portions are pressed together to effect a seal;

i) separating the loaded bag from the chain by pulling the chain away from the load station as the loaded bag is being sealed; and, j) separating the assembly from the seal bar whereby to release the loaded and now sealed bag from the machine.

2. The process of claim 1 wherein step (f) further includes reversing the assembly movement when the movement toward the seal bar is stopped.

3. A packaging machine for loading bags including a bag sealing section, the sealing section comprising:

a) a frame structure;

b) heater bar and seal bar sub-assemblies each connected to the frame structure and located at a sealing station;

c) a reciprocatable support movably connected to the frame structure, the support carrying a selected one of the sub-assemblies and forming at least a part of the connection of said selected sub-assembly and the frame structure, the support being adapted to bring the sub-assemblies together and thereby clamp a loaded bag against the heater bar sub-assembly;

d) a prime mover operatively interposed between the frame structure and the support for causing reciprocation of the support relative to the frame;

e) the selected one of the sub-assemblies including a lost motion mechanism;

f) a sensor for sensing movement of the lost motion connection relative to the support and emitting signals in response to sensed movement; and, g) control means operatively connected to the prime mover and the sensor for:

i) actuating the prime mover to cause support closing movement to relatively move the sub-assemblies from a storage position toward a closed sealing position;

ii) reversing the prime mover to terminate the closing movement on receipt of a sensor emitted signal during an initial portion of the closing movement; and, i) permitting the prime mover to continue the closing movement on receipt of one such signal during a latter portion of the closing movement.

4. The machine of claim 3 wherein the control means will cause reversal of the prime mover during said latter portion of the closing movement when one such signal is not received during such latter portion.

5. A method of operation of a packaging machine during a sealing operation comprising:

a) energizing a prime mover to cause a support to move seal pad and seal bar sub-assemblies relatively toward one another along a path toward engagement with portions of a package being formed and thereby compress the portions between the seal bar and the seal pad;

b) detecting lost motion movement of a component of one of the sub-assemblies while the prime mover is energized and causing such relative sub-assembly movement;

c) determining whether the detected lost motion movement is during an early or late portion of the relative movement of the sub-assemblies; and, d) reversing the direction of the prime mover caused relative sub-assembly movement toward one another when the detected motion was during the early portion of the sub-assembly relative movement while allowing the sub-assembly movement toward one another when the detected motion was during said late portion.

6. The method of claim 5 further including the step of determining if such lost motion movement occurs during said late portion and reversing the prime mover caused relative movement if such lost motion movement has not occurred during said late portion.

7. A package sealing mechanism comprising:

a) housing and frame structure;

b) relatively moveable heater bar and seal pad sub-assemblies connected to the structure, one of the sub-assemblies including a lost motion connection;

c) a prime mover operably connected to the sub-assemblies selectively to cause relative sub-assembly motion from a spaced package receiving and discharge position to a package sealing position and return;

d) a sensor for detecting movement of the lost motion connection; and, e) control means operably connected to the sensor and the prime mover and adapted to abort a sealing operation in response to signals from the sensor indicating an undesired condition while allowing the sealing operation to continue when the same sensor signal is indicative of a desired condition.

8. The mechanism of claim 7 wherein the undesired condition during an initial portion of the motion from the receiving to the sealing position is a sensor signal indicating lost motion movement and during a later portion of such motion the lack of such a lost motion movement indicating signal.

9. The mechanism of claim 7 wherein said one sub-assembly is the seal pad sub-assembly.

10. A process of packaging with a bagging machine for sequentially delivering end ones of a chain of interconnected preopened bags to a loading and sealing station, the machine having a seal bar and a reciprocatably mounted seal pad assembly including a pad and a coacting housing, the pad being for pressing top portions of a loaded bag to be sealed against the bar, the method comprising:

a) positioning a bag to be loaded at the station;

b) opening the positioned bag and inserting contents to be packaged;

c) moving the assembly along a path of travel toward the seal bar;

d) sensing lost motion movement of at least a selected one of the pad and housing relative to other parts of the assembly;

e) determining whether the sensed lost motion movement was during an early or a late portion of the assembly movement along the path and toward the seal bar;

f) stopping the assembly movement toward the seal bar when it is determined that the sensed lost motion movement was during the early portion;

g) allowing the assembly movement to continue toward the seal bar when it is determined the lost motion movement was in the late portion; and, h) continuing the assembly movement until said top portions are pressed together to effect a seal.

11. The process of claim 10 wherein the loaded bag is separated from the chain by pulling the chain away from the load station as the loaded bag is being sealed.

12. The process of claim 10 wherein step (f) further includes reversing the assembly movement when the movement toward the seal bar is stopped.

13. The process of claim 10 wherein the sensed lost motion movement is movement of the housing.

14. In a bagging machine for packaging products in bags of a chain of preopened bags, a sealer assembly including a jam prevention mechanism comprising:

a) an elongate heat sealer element;

b) an elongate sealer pad element;

c) reciprocatable structure interposed between and connected to the elements;

d) the structure including a prime mover for relatively moving the elements between a spaced storage position and a substantially abutting sealing position;

e) the structure also including a lost motion mechanism interposed between one of the elements and other pans of the structure;

f) the machine further including a signal emitting sensor operatively connected to the lost motion mechanism for emitting a signal when the lost motion mechanism moves relative to said other pans; and, g) circuit means operatively connected to the sensor and the prime mover for:

i) energizing the prime mover to cause relative element closing movement from the storage toward the sealing position;

ii) reversing the prime mover to terminate the closing movement on receipt of a sensor emitted signal during an initial portion of the closing movement; and, h) permitting the prime mover to continue the closing movement on receipt of one such signal during a latter portion of the closing movement.

15. The assembly of claim 14 wherein the circuit means will cause reversal of the prime mover during said latter portion of the closing movement when one such signal is not received during such latter portion.

* * * * *

UNITED STATES PATENT AND TRADEMARK OFFICE

CERTIFICATE OF CORRECTION

PATENT NO. : 5,568,718
DATED : October 29, 1996
INVENTOR(S) : Lerner et al.

It is certified that error appears in the above-indentified patent and that said Letters Patent is hereby corrected as shown below:

Column 10, line 15, should read --interposed between one of the elements and other parts--;

Column 10, line 20, should read --moves relative to said other parts; and,--

Signed and Sealed this
Eighth Day of April, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,568,718

DATED : October 29, 1996

INVENTOR(S) : Lerner et al.

It is certified that error appears in the above-indentified patent and that said Letters Patent is hereby corrected as shown below:

Column 4, line 2, should read --between the chambers of the stand and the arm.--;

Column 4, line 40, should read --includes a clamping sub-assembly 213 connected to a prime--;

Column 4, line 55, should read --extend the actuating rod 220, the clamping sub-assembly 213--;

Column 4, line 57, should read --The clamping sub-assembly 213 includes a sealing pad--;

Column 5, line 50, should read --pad 230. The pressure of the clamping sub-assembly 213--;

Column 5, line 53, should read --addition, the pressure exerted by the clamping sub-assembly--;

Column 6, line 4, should read --Upon the meeting of the clamping sub-assembly 213 and--;

Column 6, line 12, should read --able members. When the proximity sensor senses the clamp--;

UNITED STATES PATENT AND TRADEMARK OFFICE

CERTIFICATE OF CORRECTION

PATENT NO. : 5,568,718

DATED : October 29, 1996

INVENTOR(S) : Lerner et al.

It is certified that error appears in the above-indentified patent and that said Letters Patent is hereby corrected as shown below:

Column 6, line 12, should read --able members. When the proximity sensor senses the clamp--;

Signed and Sealed this

Twenty-ninth Day of April, 1997

*Attest:*

*Attesting Officer*

BRUCE LEHMAN

*Commissioner of Patents and Trademarks*